US007860417B2

(12) United States Patent
Jones et al.

(10) Patent No.: US 7,860,417 B2
(45) Date of Patent: Dec. 28, 2010

(54) SYSTEM AND METHOD FOR VARYING TRANSFER PRESSURE APPLIED BY A TRANSFER ROLLER IN A PRINTER

(75) Inventors: Michael E. Jones, West Linn, OR (US); Bjoern E. Brunner, Beaverton, OR (US)

(73) Assignee: Xerox Corporation, Norwalk, CT (US)

( * ) Notice: Subject to any disclaimer, the term of this patent is extended or adjusted under 35 U.S.C. 154(b) by 153 days.

(21) Appl. No.: 12/209,786

(22) Filed: Sep. 12, 2008

(65) Prior Publication Data

US 2010/0067933 A1 Mar. 18, 2010

(51) Int. Cl.
*G03G 15/16* (2006.01)

(52) U.S. Cl. ..... 399/66; 399/121

(58) Field of Classification Search ..... 399/38, 399/66, 107, 110, 121
See application file for complete search history.

(56) References Cited

U.S. PATENT DOCUMENTS 6,585,368 B1 7/2003 Park
6,731,891 B1 5/2004 Calamita et al.
7,643,767 B2 * 1/2010 Seto et al. ..... 399/66
7,672,605 B2 * 3/2010 Kayahara et al. ..... 399/66
2004/0001917 A1 1/2004 Urlaub et al.
2006/0238585 A1 10/2006 Kohne et al.
2007/0109383 A1 5/2007 Folkins et al.
2007/0139496 A1 6/2007 Leighton et al.

* cited by examiner

*Primary Examiner*—Hoan Tran
(74) *Attorney, Agent, or Firm*—Maginot Moore & Beck LLP

(57) ABSTRACT

A printer and method have been developed that vary the force applied by the transfer roller against the imaging member to facilitate the climb of the transfer roller as the media enters the nip and then apply an appropriate force for effective transfer of an image from the imaging member to the media. The printer includes an imaging member, a transfer roller located proximate to the imaging member, a controller being configured to generate signals that control movement of the transfer roller, and a displaceable linkage coupled to the controller to receive signals from the controller that control movement of the transfer roller and coupled to the transfer roller to move the transfer roller into and out of contact with the imaging member, the displaceable linkage applying a first move of the transfer roller into contact with the imaging member to form a transfer nip at a commanded first force, the displaceable linkage applying a second move to the transfer roller at a commanded second force, and the displaceable linkage applying a third move to the transfer roller at a commanded third force.

20 Claims, 4 Drawing Sheets

SYSTEM AND METHOD FOR VARYING TRANSFER PRESSURE APPLIED BY A TRANSFER ROLLER IN A PRINTER

TECHNICAL FIELD

This disclosure relates generally to printers having an imaging member and, more particularly, to the components and methods for controlling roller movement in a printer.

BACKGROUND

Solid ink or phase change ink printers conventionally receive ink in a solid form, either as pellets or as ink sticks. The solid ink pellets or ink sticks are placed in a feed chute and delivered to a heater assembly. Delivery of the solid ink may be accomplished using gravity or an electromechanical or mechanical mechanism or a combination of these methods. At the heater assembly, a heater plate melts the solid ink impinging on the plate into a liquid that is collected and conveyed to a print head for jetting onto a recording medium.

In known printing systems having an intermediate imaging member, the print process includes an imaging phase, a transfer phase, and an overhead phase. In ink printing systems, the imaging phase is the portion of the print process in which the ink is expelled through the piezoelectric elements comprising the print head in an image pattern onto a print drum or other intermediate imaging member. The transfer or transfer phase is the portion of the print process in which the ink image on the imaging member is transferred to the recording medium. The image transfer typically occurs by bringing a transfer roller into contact with the image member to form a transfer nip. A recording medium arrives at the nip as the imaging member rotates the image through the transfer nip. The pressure in the nip helps transfer the malleable image inks from the imaging member to the recording medium. In the overhead phase, the trailing edge of the recording medium passes out of the nip and the transfer roller is released from contacting the image member. When the image area of an image recording substrate has passed through the transfer nip, the overhead phase begins. The transfer roller may be immediately retracted from the imaging member as the trailing edge of the substrate passes through the nip, or it may continue to roll against the imaging member at a reduced force and then be retracted. The transfer roller and/or intermediate imaging member may be, but is not necessarily, heated to facilitate transfer of the image. In some printers, the transfer roller is called a fusing roller. For simplicity, the term "transfer roller" as used herein generally refers to all heated or unheated rollers used to facilitate transfer of an image to a recording media sheet or fusing the image to a sheet.

Many printers have multiple trays in which different types of recording media are stored. These different media may be different sizes of paper or polymer film recording media. These various media also have different thicknesses. As media are introduced to the transfer nip, the transfer roller climbs the lead edge of the media as the media enters the nip. Transfer of the image to the media under pressure at the nip, known as transfer or transfix, occurs nominally under uniform and constant force as the force between the transfer roller and the intermediate imaging member is regulated. The torque required for climbing the edge of a media sheet at the nip is a function of, but not limited to, the pressure of the transfer roller against the intermediate imaging member, the thickness of the media entering the nip, and the rotational speed of the intermediate imaging member. Thicker media and higher transfer roller pressures may stall the intermediate imaging member drive system with excessive drive belt slip or drive servo following error. Efforts to configure the transfer roller so it applies a single pressure to the intermediate imaging member that accommodates all the various thicknesses of media have involved tradeoffs between throughput and/or image quality/durability.

SUMMARY

A printer and method have been developed that determine multiple forces for application to a transfer roller against the imaging member to facilitate nip force control during various phases of contact with the media in the nip. The printer includes an imaging member for receiving ink ejected by a print head, a transfer roller located proximate to the imaging member, a controller configured to generate signals that control movement of the transfer roller, and a displaceable linkage coupled to the controller to receive signals from the controller that control movement of the transfer roller and coupled to the transfer roller to move the transfer roller into and out of contact with the imaging member, the displaceable linkage applying a first move of the transfer roller into contact with the imaging member to form a transfer nip at a commanded first force, the displaceable linkage applying a second move to the transfer roller at a commanded second force, and the displaceable linkage applying a third move to the transfer roller at a commanded third force. The commanded forces correspond with phases of interaction with a media sheet in the nip and these forces may differ with respect to one another. Additional commanded forces may be applied to the transfer roller for interaction with subsequent sheets in the nip. Commanded forces for subsequent sheets may correspond or differ from commanded forces used for corresponding phases in the processing of previous sheets.

A method for determining the forces may be implemented with the printer. The method includes applying a first command force to a transfer roller to move the transfer roller into contact with an imaging member to form a transfer nip, applying a second command force to the transfer roller prior to an image substrate entering the transfer nip, and applying a third command force to the transfer roller after a leading edge of the image substrate is proximate a predetermined position in the transfer nip. The application of the command forces correspond with phases of interaction with a media sheet in the nip and these command forces may differ with respect to one another. Additional command forces may be applied to the transfer roller for interaction with subsequent sheets in the nip. Command forces for subsequent sheets may correspond or differ from command forces used for corresponding phases in the processing of previous sheets.

BRIEF DESCRIPTION OF THE DRAWINGS

The foregoing aspects and other features of an ink printer implementing a system and method for varying pressure asserted by a transfer or other roller on an imaging member are explained in the following description, taken in connection with the accompanying drawings.

DETAILED DESCRIPTION

Figure 1:
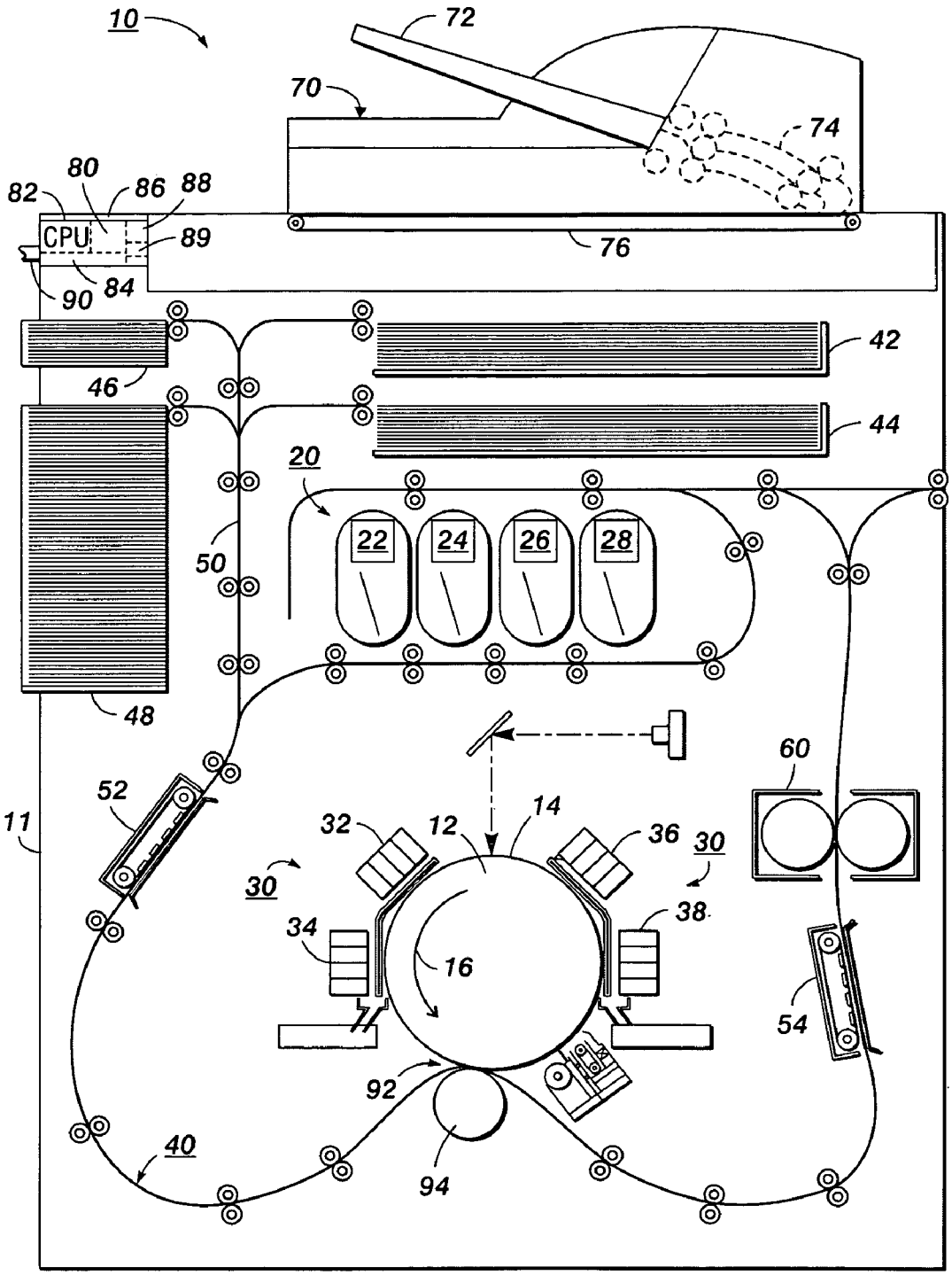
FIG. 1 PRIOR ART
FIG. 1 is a system diagram of a solid ink printer depicting the major subsystems of the ink printer.

FIG. 1 shows a system diagram of a prior art ink printer 10 that may be modified to control the application of force to a transfer roller in a way that reduces the risk of imaging member drive belt slippage or other failure during a transfer operation. The reader should understand that the embodiment of the print process discussed below may be implemented in many alternate forms and variations. In addition, any suitable size, shape or type of elements or materials may be used.

Referring now to FIG. 1, an image producing machine, such as the high-speed phase change ink image producing machine or printer 10, is shown. As illustrated, the machine 10 includes a frame 11 to which are mounted directly or indirectly the operating subsystems and components described below. The high-speed phase change ink image producing machine or printer 10 includes an intermediate imaging member 12 that is shown in the form of a drum, but can equally be in the form of a supported endless belt. The intermediate imaging member 12 has an imaging surface 14 that is movable in the direction 16, and on which phase change ink images are formed.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus for melting or phase changing the solid form of the phase change ink into a liquid form, and then supplying the liquid form to a printhead system 30 including at least one printhead assembly 32. Since the phase change ink image producing machine or printer 10 is a high-speed, or high throughput, multicolor image producing machine, the printhead system includes four (4) separate printhead assemblies 32, 34, 36 and 38 as shown.

With continued reference to FIG. 1, the phase change ink image producing machine or printer 10 includes a substrate supply and handling system 40. The substrate supply and handling system 40, for example, may include substrate supply sources 42, 44, 46, 48, of which supply source 48, for example, is a high capacity paper supply or feeder for storing and supplying image receiving substrates in the form of cut sheets, for example. The substrate supply and handling system 40 includes a substrate handling and treatment system 50 that has a substrate pre-heater 52, substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80, for example, is a self-contained, dedicated microcomputer having a central processor unit (CPU) 82, electronic storage 84, and a display or user interface (UI) 86. The ESS or controller 80, for example, includes sensor input and control means 88 as well as a pixel placement and control means 89. In addition, the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the machine's printing operations.

The controller may be a general purpose microprocessor that executes programmed instructions that are stored in a memory. The controller also includes the interface and input/output (I/O) components for receiving status signals from the printer and supplying control signals to the printer components. Alternatively, the controller may be a dedicated processor on a substrate with the necessary memory, interface, and I/O components also provided on the substrate. Such devices are sometimes known as application specific integrated circuits (ASIC). The controller may also be implemented with appropriately configured discrete electronic components or primarily as a computer program or as a combination of appropriately configured hardware and software components. The programmed instructions stored in the memory of the controller also configure the controller to implement the process described below for regulating transfer roller movement and the force applied to the transfer roller, including variations in the force applied to the transfer roller prior to a media sheet entering the transfer nip, while the sheet receives an image, and as the sheet exits the transfer nip.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example, from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by subsystem 50 in timed registration with image formation on the surface 14. The controller then generates signals that activate the drive system coupled to transfer roller 94, as described in more detail below, to move the transfer roller into contact with the intermediate imaging member 12 to form transfer nip 92. The receiving substrate then enters the nip as the transfer roller 94 climbs the substrate and the image is transferred from the surface 14 of member 12 onto the receiving substrate for subsequent fusing at fusing device 60.

Figure 2:
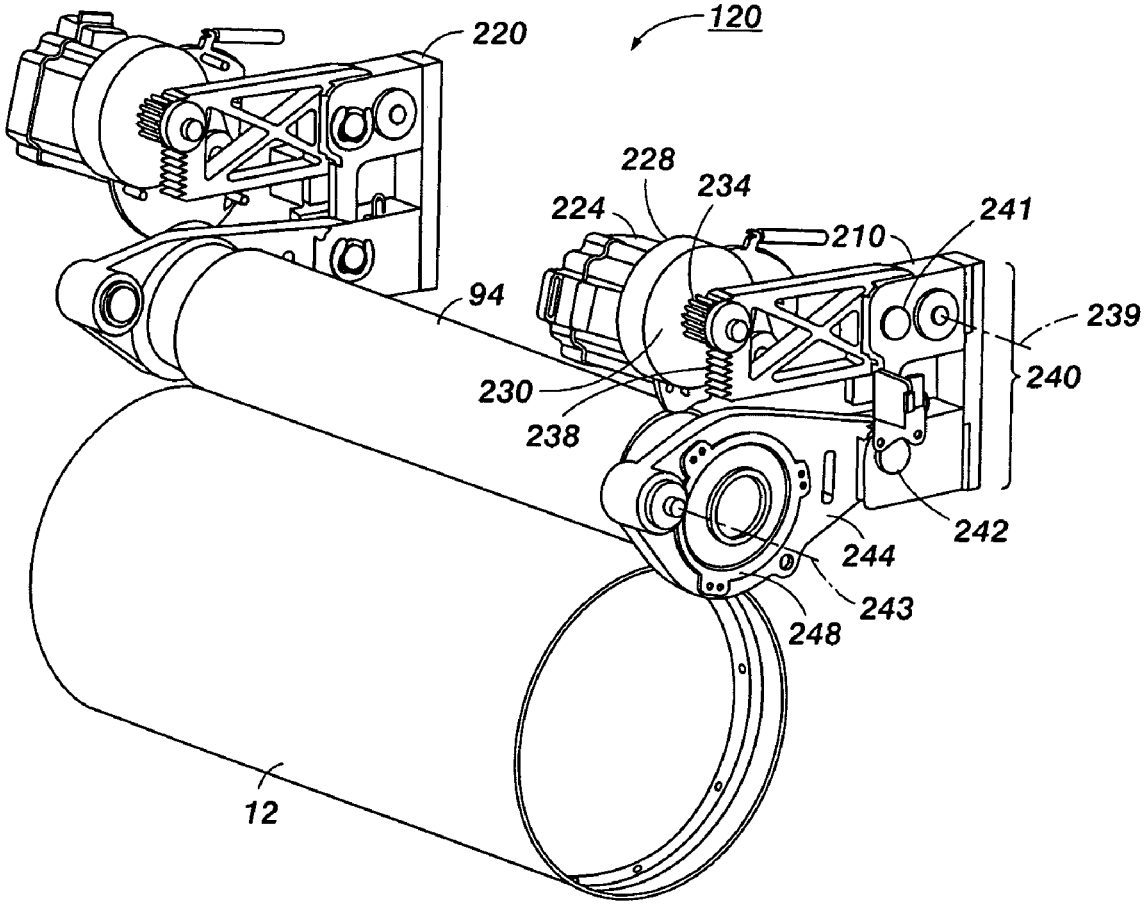
FIG. 2 PRIOR ART
FIG. 2 is a perspective view of a transfer roller control system for moving a transfer roller with reference to an imaging member.

A prior art transfer roller control system 120 for moving a transfer roller 94 with respect to an intermediate imaging member 12 is shown in FIG. 2. The system 120 includes a transfer roller control assembly 210 at one end of the transfer roller 94 and a transfer roller control assembly 220 at the other end of the transfer roller 94. As the transfer roller control assemblies 210 and 220 are essentially the same, the following description is directed to roller control assembly 210 only. The assembly 210 includes a motor 224 having a pulley (not shown) on its output shaft. An endless belt 228 is wound around the pulley on the output shaft of the motor 224 and pulley 230. At its center, pulley 230 has gear teeth 234 that engage teeth of a sector gear 238. At the outboard end of sector gear 238, a link 240 to a retainer arm 244 is mounted. Within the retainer arm 244 is an opening with a journal bearing 248 mounted therein to receive one end of the transfer roller 94. At the near end of the retainer arm 244 is a pivot pin, which allows retainer arm 244 to rotate about axis 243 as regulated by the motion of link 240. The transfer roller control assembly 220 is similarly arranged.

When the controller generates a signal to operate the motor 224, its output shaft rotates causing the endless belt 228 to rotate the pulley 230. As pulley 230 rotates, the gear teeth 234 rotate the sector gear 238 about bearing axis 239. Link 240 at the outboard end of the sector gear 238 is coupled to the sector gear 238 by pivot pin 241 and coupled to retainer arm 244 by pivot pin 242. Rotation of section gear 238 urges the link 240 to move and link 240 urges the retainer arm 244 to rotate about the axis 243. Thus, the end of the transfer roller within bearing 248 is moved by bidirectional control of the motor 224. Operation of the motor 224 in the assembly 210 and the corresponding motor in the assembly 220 is coordinated by the controller so the transfer roller 94 moves smoothly into and out of engagement with the imaging member 12. In one embodiment, the operations of these motors are independently controlled. The assemblies 210 and 220 may also include sensors, such as a strain gauge mounted to link 240 or a sensor that measures deflections of link 240. The sensors in these assemblies provide an indication of the pressure being exerted by the transfer roller 94 against the imaging member 12. The pressure signals may be used by the controller as feedback for regulation of the signals controlling the motors in the assemblies 210 and 220 thereby regulating the force of transfer roller 94 against the imaging member 12.

While one embodiment of a transfer roller control assembly has been described, other embodiments may be used. The other embodiments may be comprised of a roller control assembly for each end of a transfer roller or it may be comprised of a single assembly that controls both ends of the transfer roller. What is required of the various transfer roller control embodiments is that the transfer roller control operate as a displaceable linkage to move the transfer roller into and out of engagement with the imaging member in response to control signals that move the linkage through a range of motion. The range of motion is defined at one end as being disengaged from the imaging member and, at the other end of the range, as being pressed against the imaging member with sufficient pressure to form a transfer nip. Additionally, similar control assemblies may be used with other rollers in the printing process that selectively engage an imaging member routed through a printer. The system and method described below may be used to control the movement of these rollers and the force applied to these rollers as well.

The system and method described more fully below operates the displaceable linkage to implement a method to regulate the application of a force with a transfer roller. In general, the controller may be configured to move a roller towards an imaging member and apply different forces at different times to the roller. For example, the controller may move a transfer roller with a first force to form transfer nip, then apply a second force to facilitate a climb of a media sheet leading edge, then apply a third force to provide image transfer, and then apply a fourth force to assist the exit of the sheet from the nip. Continuing the example, the controller may apply the fourth force at one level if another media sheet is immediately following the sheet previously processed or at a different level if no other sheet is immediately available. If a second sheet is following, the fourth force may accommodate a brief period of time in which the roller contacts the opposing structure forming the nip and then climbs the next sheet. A fifth force may be commanded by the controller to facilitate transfer of an image to the second sheet, and then a sixth force may be commanded by the controller for the exit of the second sheet. The forces commanded by the controller may be set at predetermined levels or at levels determined by the controller with reference to the thickness of the media sheet in the nip and the surface speed of the imaging member.

Figure 3:
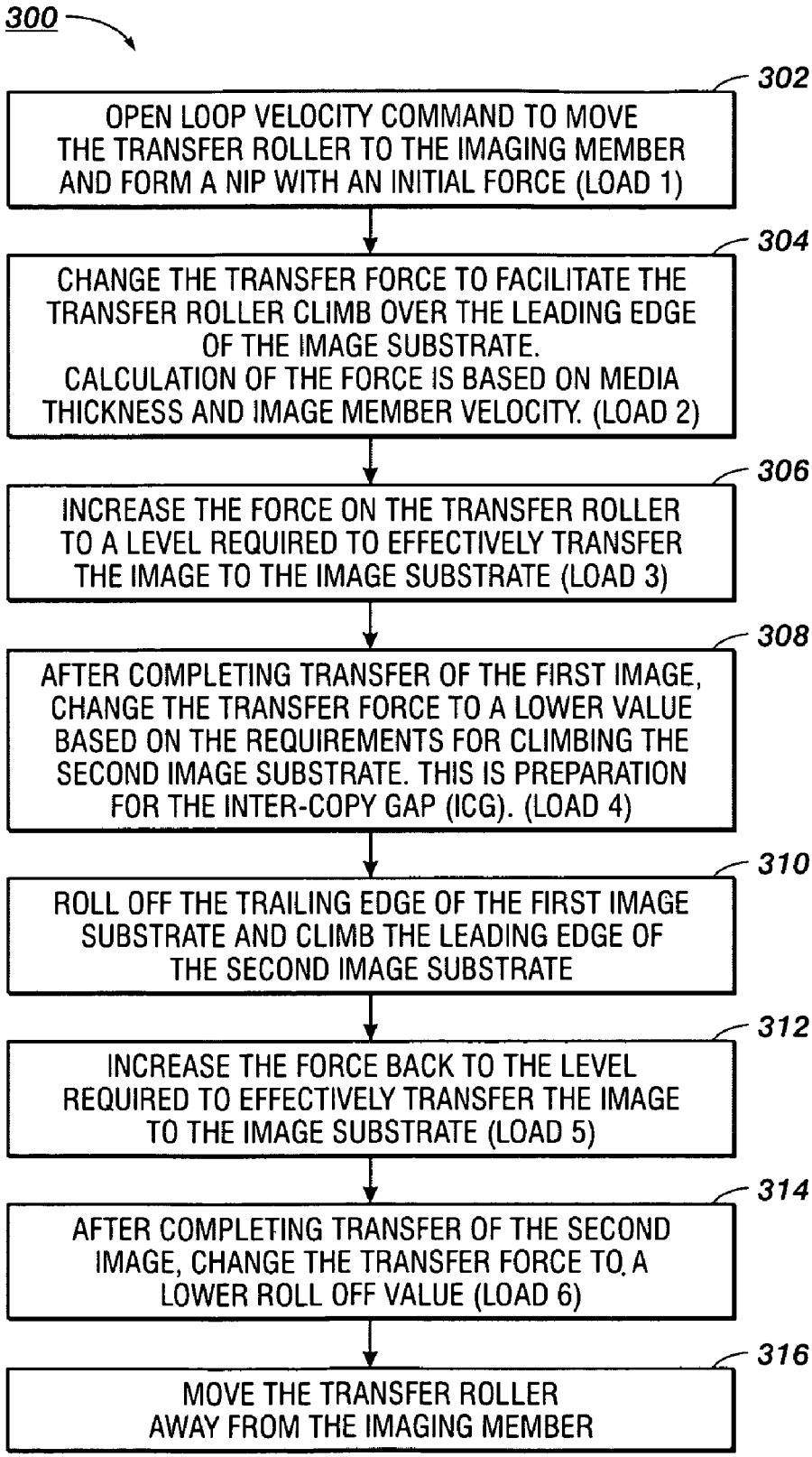
FIG. 3 is a flow diagram of a sequence in which the transfer roller position and forces are controlled during an example print operation.

One embodiment of a method for implementing roller control is shown in FIG. 3. The controller initiates a first open loop velocity command signal in conjunction with a first command force signal (block 302) to move the transfer roller into contact with the imaging member to form the transfer nip. Contact between the transfer roller and the imaging member causes the sensors in the transfer mechanism to generate signals identifying the magnitude of the force being applied by the transfer roller. These signals may be used by the controller to regulate the transfer force applied by the transfer roller in response to any given force commanded by the controller during the process 300. A second force is commanded by the controller that is different than the first force used to form the first nip (block 304). This second force facilitates the climb of the transfer roller up the leading edge of the first image substrate entering the nip after formation of the nip. The second force, in one embodiment, is applied in response to a climb signal generated by the controller. Upon completion of the climb, a third force is applied to the transfer roller to transfer a first image from the imaging member to a first image substrate (block 306).

In the example process described in FIG. 3, two images are sequentially transferred to two separate image substrates. Following completion of the first image process, a fourth force is commanded by the controller that is different than the third commanded force. In this example, the fourth force is lower than the third force (block 308). This fourth force facilitates climb of the transfer roller up the leading edge of the second image substrate. The transfer roller rolls off the trailing edge of the first image substrate onto the imaging member for a short distance called the inter-copy gap, and then climbs the leading edge of the second image substrate (block 3 10). Upon completion of the climb, a fifth force, which in the example is approximately the same as the third force, is commanded by the controller (block 312). After the second image is transferred, a sixth force is commanded by the controller in preparation for rolling off the trailing edge of the second substrate (block 314). The substrate exits the nip and the transfer roller again rolls onto the imaging member. The controller initiates an open loop velocity command signal and the transfer roller is moved away from the imaging member (block 316).

Figure 4:
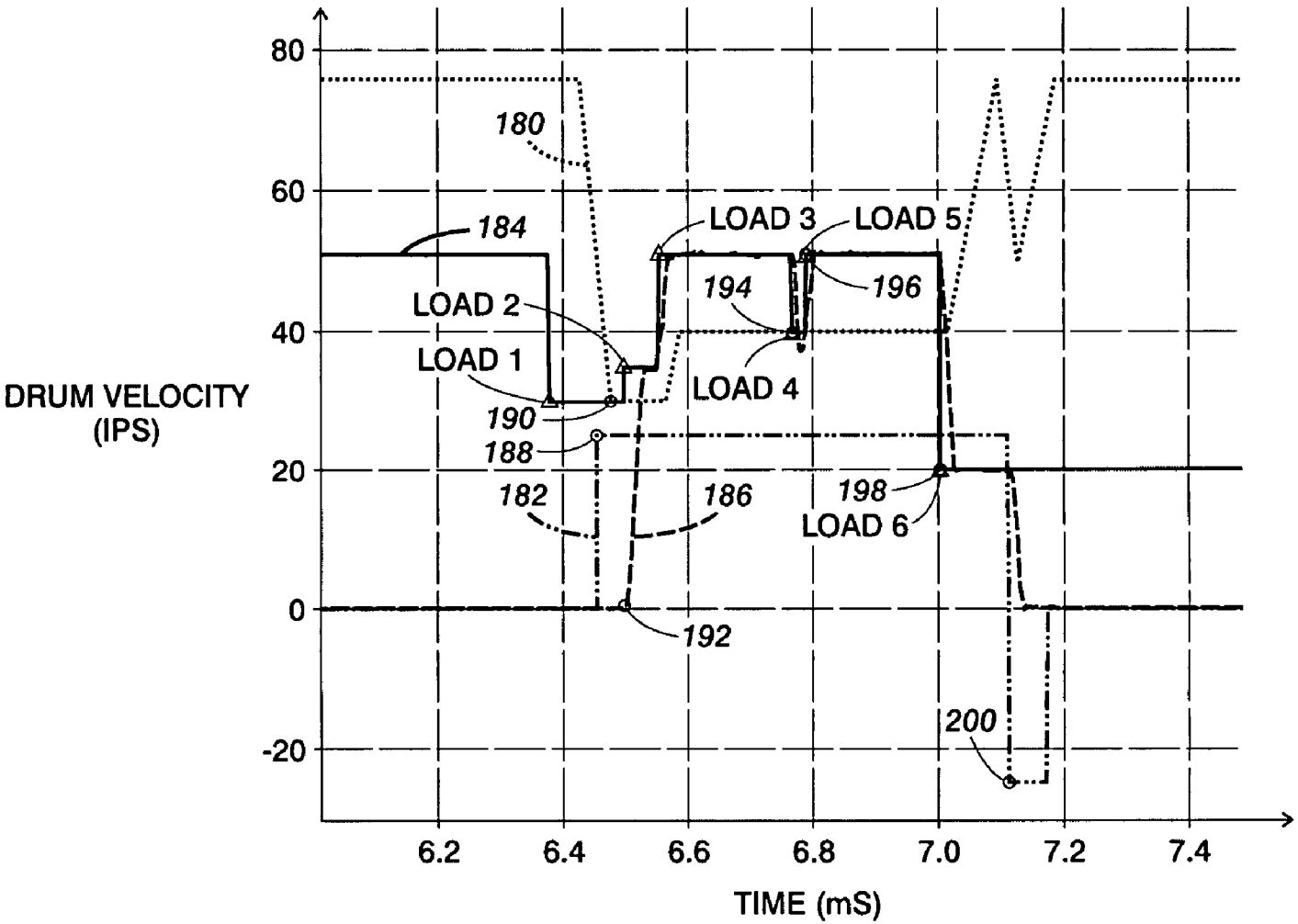
FIG. 4 is a graph depicting the relationship between rotational speed of an imaging member, command velocity of the transfer roller, and the force applied to a transfer roller.

In an improved printer that helps the transfer roller 94 climb the leading edge of an image substrate, the transfer roller 94 is moved to an intermediate position. At the intermediate position, the transfer roller forms a transfer nip with the imaging member 12 at a pressure that is less than the image transferring pressure. The relationship between imaging member velocity and transfer roller pressure is shown in FIG. 4. The surface speed of the imaging member is depicted by line 180. The open loop command velocity of the transfer roller is shown by line 182. This command controls the position of the transfer roller with respect to the imaging member 12 while the transfer roller is not in contact with the imaging member and while the force being applied is not being regulated with reference to signals from the sensors in the transfer mechanism. In FIG. 4, the line 184 refers to the transfer force commanded against the imaging member, and the transfer force as measured by the sensors in the transfer mechanism is shown by line 186. In the figure, the transfer forces shown are for the front side of the transfer roller as an independent servo mechanism is coupled to each end of the transfer roller. One end of the transfer roller is referred to as the front side and the other end is referred to as the back side.

As image formation on the member 12 nears completion, a command contact force shown as load 1 of approximately 3000 Newtons is set. Load 1 enables the controller to use independently the open loop command velocity of the servo mechanism to control the position of the transfer roller while the transfer roller is not in contact with the imaging member 12, and to use a command velocity of 25 mm/second without the command force overriding the command velocity control of the transfer roller. The imaging member surface speed is reduced to approximately 30 in/second as illustrated at timing point 190. While the imaging member speed is slowing, the transfer roller open loop command velocity is set to 25 mm/second as shown at point 188. This velocity command begins movement of the transfer roller toward the imaging member 12 from an initial gap of approximately 1 mm. Approximately 20 milliseconds after timing point 190, the transfer roller contacts the imaging member and begins to generate a measured force (line 186) substantially greater than zero as shown at point 192. At this time, the controller sets the command climb force, which is load 2 in the figure, to approximately 3470 Newtons, in this example. Line 186 shows the response as the measured force increases, and shortly thereafter reaches the command climb force. Approximately 50 milliseconds after the command climb force is set, the transfer roller begins to climb the leading edge of the image substrate. Correspondingly, the measured force 186 also increases. Approximately 55 milliseconds after the command climb force is set, the leading edge of the image substrate is centered in the nip. The transfer roller climb is now complete and the controller sets the command transfer force, which is denoted as load 3 in the figure and which is approximately 5100 Newtons in this example. The servo mechanism measured force response to the climb event and the command climb force applied to the front end of the transfer roller is shown by line 186 increasing and reaching the command force line 184. The reader should note that the velocity and travel distances depicted in FIG. 4 are examples of one possible implementation only. These values were influenced by the product mechanism, drive capabilities, allowance for image position relative to substrate edges, and printer component geometry.

In this embodiment, two individual images separated by approximately 28.6 mm have been formed on imaging member 12. These images are transferred onto two separate image substrates. Prior to rolling off of the trailing edge of the first image substrate, the command force is reduced to approximately 4000 Newtons, which corresponds to load 4 at point 194. When the lead edge climb event of the second image substrate is complete, the command force is set to load 5, which corresponds to point 196 in the figure. In this example, the magnitudes of load 3 and load 5 are equal, although they may differ.

After the transfer operation for the last image is complete, the controller generates a signal to reduce the command force to load 6, which is approximately 2000 Newtons, as shown at point 198 in FIG. 4. The transfer roller rolls off the trailing edge of the last image substrate and onto the surface of the imaging member. The transfer roller continues to roll against the imaging member surface until the open loop command velocity is set to −25 mm/second, as shown at point 200, at which time the servo mechanism retracts the transfer roller from the imaging member surface and returns it to its starting position holding a 1 mm gap between the transfer roller and the imaging member. While this discussion has been made with reference to the front end of the transfer member, the controller generates corresponding signals to operate the servo mechanism for the rear end of the transfer member in a similar manner.

Operating the transfer roller in this manner has been observed to provide a number of benefits. For one, the use of a reduced and predetermined climb force, such as load 2 for the leading edge of the first image substrate and load 4 for the leading edge of the second image substrate, lowers overshoot of the forces and pressures actually applied to the image substrates and the imaging member. Another benefit is a reduction in belt slip with reference to the belt used to drive the imaging member. Additionally, the current used by the motor that drives the imaging member is reduced. Consequently, use of a reduced and predetermined climbing force reduces the load on the imaging member during the climbing phase with improved operating characteristics.

The transfer roller force must be increased, however, from the lower climb force to the higher transfer force for effective transfer of an image. This increase ideally occurs during the time between the end of the climb and the start of the image on the imaging member entering the nip. Determining a climb force that provides the maximum benefits described while also minimizing any compromise of the transfer force at the start of the image is desirable. A more optimal climb force can be empirically determined from measurements of belt slippage, imaging member motor current, imaging member position error, and the measured transfer force. One goal in determining an optimal command climb force is to offset the difference between the command transfer force and the command climb force by the incremental increase in force that occurs due to the system stiffness of the transfer mechanism and structure as it is deflected by the climb event. Determining such an optimal climb force enables the transfer force to be achieved with minimal delay and minimal overshoot. Consequently, a climb force versus media thickness curve, table, or equation is influenced by the stiffness of the transfer system.

In one embodiment, the command climb force is determined by these responses and calculated by an equation using the input variables media thickness and image member velocity. Thus, the command climb force may be characterized by an equation that relates the force to media thickness and image member velocity with the result that the image member motor current, belt slip, and following error responses are improved. Furthermore, transfer roller force responses are improved. In one embodiment, the equation is expressed as follows:

$$F=A*V*T+B*V+C*T+D$$

Where the result F is the command climb force per side in Newtons. The equation constants are empirically determined in this example and are defined as follows: A=11.665, B=0.146, C=−22962.9, D=4962.9. The input variable V is the imaging member surface velocity in mm/second, and the input variable T is the media thickness in mm.

In one embodiment, a limited range is determined for the climb force result. Such a limitation is implemented when thicker media may result in a calculated command climb force that is less than the range minimum, but the range minimum is used. Likewise, when thinner media may result in a calculated command climb force that is greater than the maximum of the range, but the range maximum is used. In this example, the command climb force range is 0 Newtons to 5100 Newtons.

In one embodiment, a climb force versus media thickness and imaging member velocity equation is calculated by the printer controller. During a print cycle, the controller retrieves a media thickness and an imaging member transfer velocity stored in memory for the image substrate handled by the subsystem 50. The media thicknesses are parameters of the various media stored in the media trays of the printer. In one embodiment, media may be fed by a user into a single sheet feeder or loaded into a supply tray. After loading the media, the user may be queried for entry of the media thickness before the print cycle is commenced. Once the media thickness is determined, the controller generates the signals that cause the servo mechanisms for the front and the back ends of the transfer roller to move the transfer roller towards the imaging member. After contact with the imaging member, the controller generates the signal that causes the servo mechanisms to change the force applied to the transfer roller ends in preparation for the climb event. Upon completion of the climb operation, the controller generates the transfer signal and the force applied to the ends of the transfer roller is increased to the transfer force for transfer of the image from the imaging member to the image substrate. At the conclusion of the image transfer, the controller generates a release signal to move the transfer roller out of contact with the imaging member.

As described above, the selective control of force applied to a transfer member may be used to reduce the force applied to the ends of the transfer roller during the release of the image substrate. In such an operation, the force is reduced to a force, such as the one referenced as load 6 in FIG. 4. Using such a force to reduce the force applied to the transfer roller in the region between the end of the image and the trailing edge of the substrate helps avoid belt slip conditions. These conditions are typically encountered with thicker media. Such media include sheets with tabs, business cards, labels, envelopes, folded sheets, multi-sheet documents, preprinted forms, or sheets having ink of various thicknesses. Furthermore, the reduced force lowers the power required to drive the imaging member as the transfer roller continues to roll against the imaging member after image transfer is complete as required in some printing cycles.

Force generation with a drive transferring motion through a belt has been described with reference to the displaceable linkage implementation above. This drive configuration is only one of many drive options, however, as other drive systems may be used. For example, direct drives with rotary or linear motors, lead screws, gears, or a gear and rack configuration, traction drive, pneumatic drive, or a non-toothed pulley systems, and various combinations thereof, may be used. Selection of an appropriate drive system is chiefly dependent upon efficiency, cost, speed, and/or response time, product architectural compatibility and force generation and/or force amplification. The priorities of these various parameters are application specific. Also, the system and method described above have been explained with reference to an imaging member, such as a print drum or an endless belt, which receives an image that is later transferred to an image substrate. As used herein, an imaging member may also refer to media that receives an image directly from one or more printheads and then later has the image fixed to the substrate. For example, a web of media or series of sheets may receive images and then have the ink images more permanently affixed to the substrate by subsequent heated or non-heated rollers. As noted above, the term transfer roller includes these rollers that may be used to affix the image to the image receiving member with variable pressures. The pressure or force applied may be determined by substrate position, and/or input or sensed substrate thickness, and/or lookup tables, and/or sensed or determined force, position, velocity, and/or acceleration values for moving elements in the printing and transfer process.

While transfer roller front and rear end forces are generally equivalent and applied to the roller ends, the commanded and applied forces may be asymmetrical in response to non-centered substrate positions, variations in image substrate thickness along the transfer roller length, or other characteristics of the transfer roller or other elements. Therefore, transfer process signals may comprise unique values for each side for some or all of the commanded and applied transfer forces. Because specific substrate differences are secondary to transfer force influence, the variations of force used in the above-described method and system may be implemented to establish desired forces in real time that are based on controller modifications of calculations or values described above with measured signals or determined effects related to substrate thickness, velocities, image content, and other applicable parameters exclusive of or in conjunction with default or lookup table values.

Those skilled in the art will recognize that numerous modifications can be made to the specific implementations described above. It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

We claim:

1. A printer comprising:

an imaging member;

a transfer roller located proximate to the imaging member;

a memory in which climb force versus media thickness data and imaging member velocity data are stored;

a controller being configured to determine a climb force corresponding to a media thickness and an imaging member velocity stored in the memory and to generate a signal for moving the transfer roller with reference to the determined climb force; and a displaceable linkage operatively connected to the controller to receive the generated signal from the controller and operatively connected to the transfer roller to move the transfer roller into and out of contact with the imaging member, the displaceable linkage applying a first move of the transfer roller into contact with the imaging member to form a transfer nip at a commanded first force, the displaceable linkage applying a second move to the transfer roller at a commanded second force, and the displaceable linkage applying a third move to the transfer roller at a commanded third force.

2. The printer of claim 1, the controller being configured to generate a signal for a servo mechanism coupled to one end of the transfer roller and to generate another signal for another servo mechanism coupled to another end of the transfer roller.

3. The printer of claim 1, the controller being configured to generate a signal that enables the displaceable linkage to move the transfer roller prior to entry of a leading edge of an image substrate into the transfer nip.

4. The printer of claim 1, the controller being configured to generate a signal for the commanded second force as the leading edge is proximate a predetermined position in the transfer nip.

5. The printer of claim 1, the controller being configured to generate a signal for the commanded third force as an image area on the imaging member passes out of the transfer nip.

6. The printer of claim 3, the controller being configured to generate a signal for a commanded fourth force as a trailing edge of the image substrate is proximate a predetermined position in the transfer nip.

7. The printer of claim 1, the displaceable linkage comprising:

a retainer arm for rotatably holding one end of the transfer roller;

a link coupled to the retainer arm;

a sector gear coupled to the link to move the link and retainer arm;

a gear having teeth that intermesh with the sector gear; and a motor having a rotating output shaft that is coupled to the gear, the motor being coupled to the controller to receive the signals generated by the controller and to rotate the gear to move the transfer roller in accordance with the signals received from the controller.

8. A method for moving a transfer roller during a print cycle comprising:

applying a first command force to a transfer roller to move the transfer roller into contact with an imaging member to form a transfer nip;

applying a second command force to the transfer roller prior to an image substrate entering the transfer nip; and applying a third command force to the transfer roller after a leading edge of the image substrate is proximate a predetermined position in the transfer nip.

9. The method of claim 8, the application of the second command force further comprising:

determining a climb force corresponding to a media thickness for an image substrate entering the transfer nip and an image member velocity; and generating a signal to move the transfer roller in accordance with the determined climb force.

10. The method of claim 9, the signal generation further comprising:

generating a first signal for a servo mechanism coupled to one end of the transfer roller; and generating a second signal corresponding to the first signal for another servo mechanism coupled to another end of the transfer roller.

11. The method of claim 9 further comprising:

generating the signal prior to entry of a leading edge of an image substrate into the transfer nip.

12. The method of claim 9, the application of the third command force further comprising:

generating a signal to apply the third command force as a leading edge of an image substrate is proximate a predetermined position in the transfer nip.

13. The method of claim 9 further comprising:

generating another signal to move the transfer roller as an image area on the imaging member passes out of the transfer nip.

14. The method of claim 13 further comprising:

generating a signal to apply a fourth command force to move the transfer roller as a trailing edge of the image substrate is proximate a predetermined position in the transfer nip.

15. A printer comprising:

an imaging member for receiving ink ejected by at least one printhead;

a transfer roller located proximate to the imaging member;

a displaceable linkage coupled to the transfer roller to move the transfer roller into and out of contact with the imaging member, the displaceable linkage comprising:

a retainer arm for rotatably holding one end of the transfer roller;

a link coupled to the retainer arm;

a sector gear coupled to the link to move the link and retainer arm;

a gear having teeth that intermesh with the sector gear; and a motor having a rotating output shaft;

a controller for generating signals that are coupled to the motor of the displaceable linkage to cause the motor to rotate the gear and move the transfer roller, the controller being configured to generate signals for causing the motor to move the transfer roller; and the motor responds to one generated signal to rotate the gear to apply a first force to the transfer roller to move the transfer roller and form a transfer nip with the imaging member, the motor responds to another generated signal to rotate the gear to apply a second force to the transfer roller that is different than the first applied force to enable the transfer roller to climb an image substrate entering the transfer nip, and the motor responds to another signal to rotate the gear to apply a third force to the transfer roller that is greater than the first applied force.

16. The printer of claim 15, the controller being configured to generate another motor signal as a trailing end of the image substrate on the imaging member exits the transfer nip; and the motor responds to the other motor signal to apply a fourth force to the transfer roller.

17. The printer of claim 16, the controller being configured to generate another motor signal as a trailing edge of the image substrate is proximate a predetermined position in the transfer nip; and the motor responds to the motor signal by moving the transfer roller away from the imaging member.

18. The printer of claim 16 wherein the controller generates the motor signal a predetermined time after the transfer nip is formed.

19. The printer of claim 16 wherein the controller generates the signal to apply the third force as the image substrate is proximate the predetermined position in the transfer nip.

20. A printer comprising:

an imaging member;

a transfer roller located proximate to the imaging member;

a memory in which climb force versus media thickness data and imaging member velocity data are stored;

the controller being configured to select a climb force corresponding to a media thickness and imaging member velocity and to generate a first signal corresponding to a first selected climb force, a second signal corresponding to a second selected climb force, and a third signal corresponding to a third selected climb force; and a displaceable linkage operatively connected to the controller and to the transfer roller, the displaceable linkage moving the transfer roller into contact with the imaging member to form a transfer nip at a commanded first force in response to the first signal being received from the controller, the displaceable linkage moving the transfer roller at a commanded second force in response to the second signal being received from the controller, and the displaceable linkage moving the transfer roller at a commanded third force in response to the third signal being received from the controller.

* * * * *